US005842783A

United States Patent [19]

Boasso et al.

[11] Patent Number: 5,842,783

[45] Date of Patent: Dec. 1, 1998

[54] SPARGER MIXING SYSTEM

[76] Inventors: Walter J. Boasso, 7300 N. Peters St., Arabi, La. 70032; Scott E. Leonard, 249 Clara Dr., Slidell, La. 70458

[21] Appl. No.: 757,890

[22] Filed: Nov. 27, 1996

Related U.S. Application Data

[60] Provisional application No. 60/007,648 Nov. 28, 1995.

[51] Int. Cl.[6] ..... B01F 13/02

[52] U.S. Cl. ..... 366/101; 261/121.1; 261/124

[58] Field of Search ..... 366/101, 107, 366/105, 106; 261/119.1, 121.1, 124; 239/143, 144

[56] References Cited

U.S. PATENT DOCUMENTS

| | | | |
|---|---|---|---|
| 2,241,940 | 5/1941 | Atkins et al. | 261/124 |
| 3,103,226 | 9/1963 | Greiman | 261/124 |

*Primary Examiner*—Tony G. Soohoo
*Attorney, Agent, or Firm*—Joseph T. Regard, Ltd.

[57] ABSTRACT

A system for portably mixing the contents of a transport tank in an inexpensive, portable manner which is adaptable for use in conjunction with non-specialized container tanks and the like, providing a temporary system to convert a container tank into a sparger tank.

4 Claims, 5 Drawing Sheets

SPARGER MIXING SYSTEM

This application claims benefit of U.S.C. Provisional Appln. No. 60/007,648 filed Nov. 28, 1985.

TECHNICAL FIELD OF THE INVENTION

The present invention relates to transport tanks or the like, as utilized in containerized transport systems, and more specifically to a system for portably mixing the contents of a transport tank in an inexpensive, portable manner which is adaptable for use in conjunction with non-specialized container tanks and the like, providing a temporary system to convert a container tank into a sparger tank.

BACKGROUND OF THE INVENTION

A sparger system is a specialized shipping tank, which has installed therein an aeration system therein, generally in the form of a conduit array which has formed therein a series of vent holes.

What makes sparger systems desirable is that a product, such as, for example, a powdered chemical concentrate, often in cake form, can be shipped in a sparger tank dry, at significant weight reduction when compared to a tank of the same, unconcentrated, liquid chemical, resulting in a significantly less shipping cost. When the sparger system arrives at the location, the user merely fills the tank with the desired amount of liquid, affixes a source of compressed air to the pipe array, generally via an exterior fitting, and initiates venting of air through the pipe array, which creates air bubbles in the concentrate/water mixture, mixing same.

While a sparger system has its cost benefits, it also has its drawbacks. First, a sparger tank is significantly more expensive to fabricate, maintain, and clean than a comparable empty tank. Second, and perhaps even more costly, is the loss of use of most sparger tanks when they are shipped back to the operator. An operator typically desires to utilize a shipping container, tank car, or the like for shipping both on the initial delivery as well as the return run. Often, after an empty standard tank container has been emptied at a location, it is cleaned by a local agency or contractor, loaded with goods from a customer at that general location for a destination in the vicinity of the operator, and shipped back.

A sparger tank system, however, is often such a specialized system, that it can only be utilized to ship a product compatible with the system (as well as the specialized cleaning requirements), and it is often the rule that the a shipped sparger tank must be return shipped empty.

GENERAL SUMMARY DISCUSSION OF THE INVENTION

Unlike the prior art, the present invention provides an easily implemented, relatively inexpensive, and very effective system to convert any shipping tank, including ISO portable container shipping tanks, into a sparger unit for temporary use, including even a single shipment.

The present invention relates to transport tanks or the like, as utilized in containerized transport systems, and more specifically to a system for portably mixing the contents of a transport tank in an inexpensive, portable manner which is adaptable for use in conjunction with non-specialized container tanks and the like The present invention provides an alternative to the utilization of Sparger tanks, which comprise specialized mixing tanks of greater expense and limited use. The present invention allows the shipment of materials which require mixing in a standard tank, mixing said contents upon shipment, removal of the invention components, and utilization of the standard tank in a standard shipping capacity for the return trip.

Sparger tanks, on the other hand, as discussed, in addition to being expensive to manufacture and maintain, also often necessitate shipping the empty tank back on the return trip, resulting in a doubling in shipping expenses, a wholly inefficient and expensive prospect.

It is therefore an object of the present invention to provide a system for the economical conversion of existing ISO portable tanks into a sparger tank for a shipment of goods, then remove the relatively inexpensive sparger conversion unit, clean the tank, load with any liquid cargo, and return ship. It is believed that the present system can be made so economically as to be disposable, wherein the user.

It is another object of the present invention to provide a shipping system which is convertible from sparger to regular shipping tank, and visa-versa.

It is still another object of the present invention to provide a sparger conversion kit for easily and inexpensively converting a shipping tank into a sparger unit.

Lastly, it is an object of the present invention to provide a sparger conversion unit which may be utilized in conjunction with a wide variety of cargo.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1A:
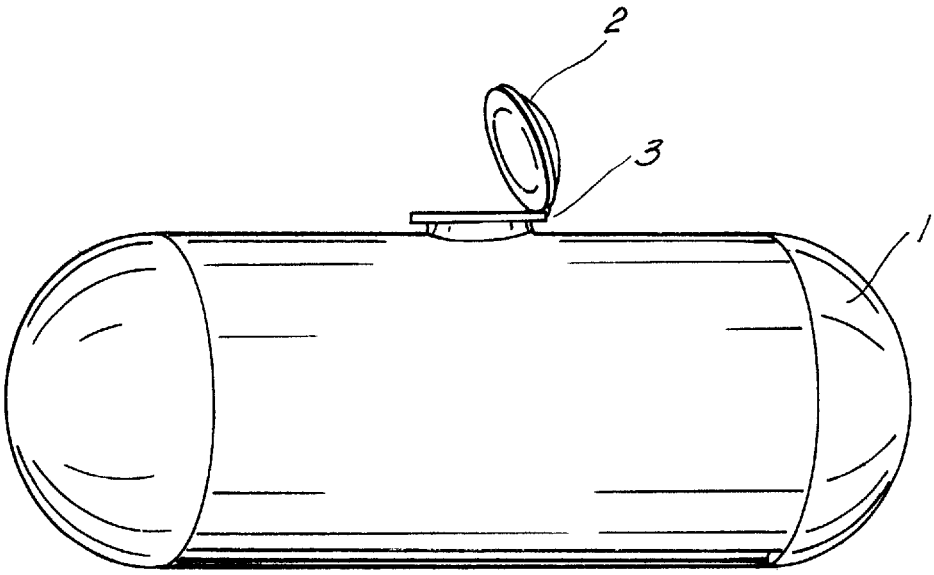
FIG. 1*a* is a side view of an exemplary shipping tank as may be utilized in the present invention.
Figure 1B:
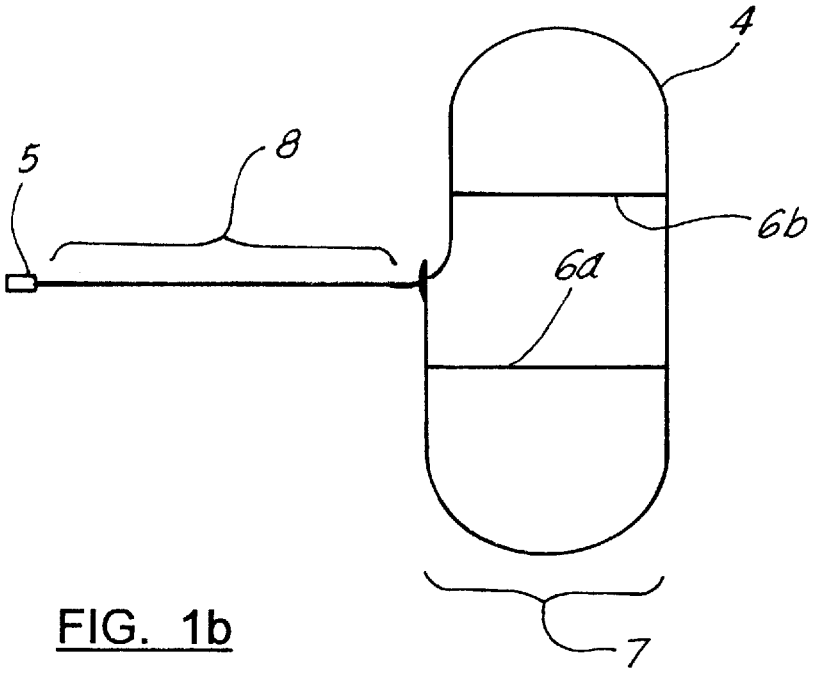
FIG. 1*b* is a top view of the preferred embodiment of the sparger mixing hose of the system of the present invention.

FIG. 1*a* illustrates an exemplary container shipping tank 1 having, for example, 32000 Kg (14,512 pound) capacity, having a man lid 2 hingedly connected to the upper side of the tank. The preferred embodiment of the present invention is utilized in conjunction with ISO portable tanks as described by the International Organization for Standardization based in Geneva, Switzerland FIG. 1*b* illustrates an exemplary air hose 4, which may be, for example, ¾ inch air hose, having, for example, 250 PSI capacity. The hose has a first end having a coupling 5 thereon, and a second end having a body 7 forming a loop having a plurality of perforations thereon, having, for example, 11/64 inch holes dispersed about the body area, along one longitudinal side of the hose. Other size and configuration aeration orifices could be implemented with like results, or perhaps even work better, depending upon, among other criteria, the density of the concentrate, the specific gravity of the fluid, the pressure of the compressed air supply, etc.

The loop forming the body of the hose may further include cross member hoses 6*a*, 6*b*, also having perforations formed therein, said cross members (which could be, for example, four (4) feet long) fluidly connected at their ends to said loop forming the body 7. More cross-members could be implemented in the present system, as necessary and desirable. Separating the body 7 from the connection 5 at the first end is an extension length of hose 8 of adequate length (which could be, for example, fifteen (15) feet) to allow said body 7 to be laid upon the floor of the tank, with the perforations in the hose directed upwards, as opposed to against the floor of the tank, and the coupling be affixed to the man lid area of the tank, as shown in FIG. 2.

Prior to entering the tank, it should be metered to ensure suitability for man entry. Enter tank and bring all hoses and fittings into the tank, in assembled or unassembled form. Man entry should be accomplished with a ladder that is attached to the neck ring of the tank container. Typically, disposable foot protection should be worn. Suitable lights should be used only after the tank has been metered for oxygen content and flammability.

Figure 2:
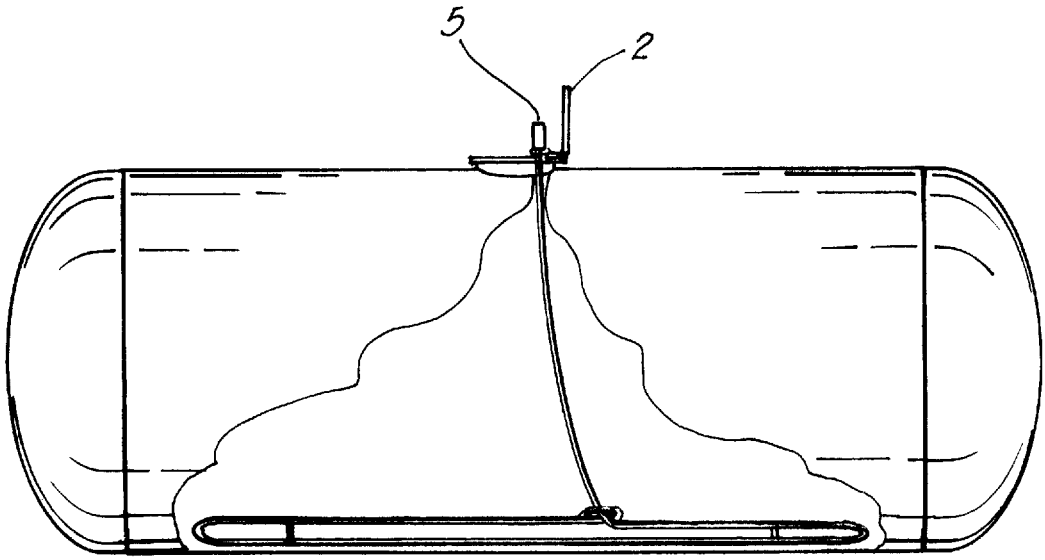
FIG. 2 is a side view of the invention of FIG. 1*b*, illustrating the placement of the sparger hose into the exemplary tank.

As further shown in FIG. 2, the body of the hose is laid upon the floor and lower wall area of the tank in a spaced apart, flat manner, such that said body covers a substantial area of the floor of the tank. The hose connection 5 of the preferred embodiment of the present invention is a chicago-type coupling, and is connected to the man lid 2 area of the tank, and can be secured via wire, hook, or the like, and can be secured to the inner side of the man lid, or somewhere within the tank within the grasp of the man lid area when the tank is filled.

Figure 3:
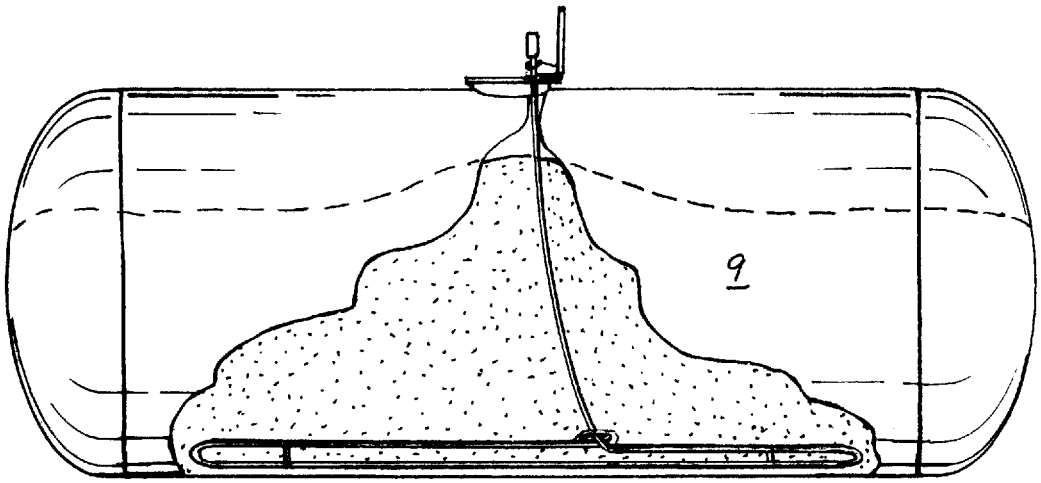
FIG. 3 is a side view of the invention of FIG. 1*b*, illustrating the loading of concentrate into the tank, over the sparger hose.

In use, after the hose is installed in place as above, referring to FIG. 3, a fluid soluble shipment such as, for example ROUNDUP brand pesticide in dry, caked form 9, is poured in through the man lid into the tank, filling same, and covering the body of the hose, while leaving the connection end exposed in the vicinity of the man lid. The man lid is then closed, and the item may be shipped as a normal container tank. It is noted that all loading should occur through the man lid cover, and not a lower outlet, as lowering in a lower outlet could disturb the placement of the sparger hoses and render them inoperable.

Figure 4A:
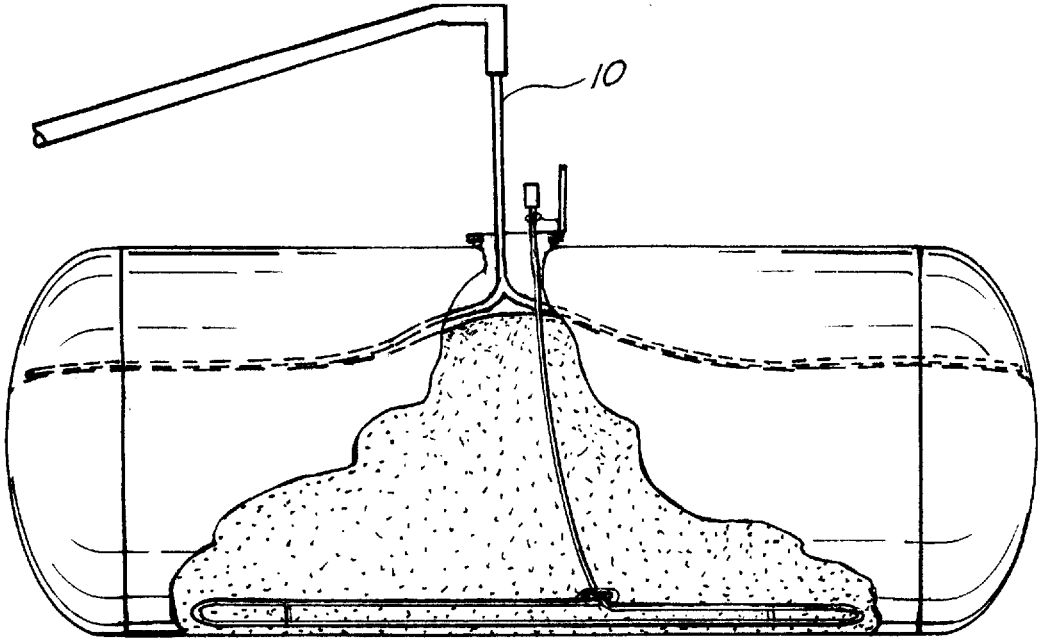
FIG. 4*a* is a side view of the invention of FIG. 1*b*, illustrating the filling of liquid water or other liquid media into the tank of FIG. 3.
Figure 4B:
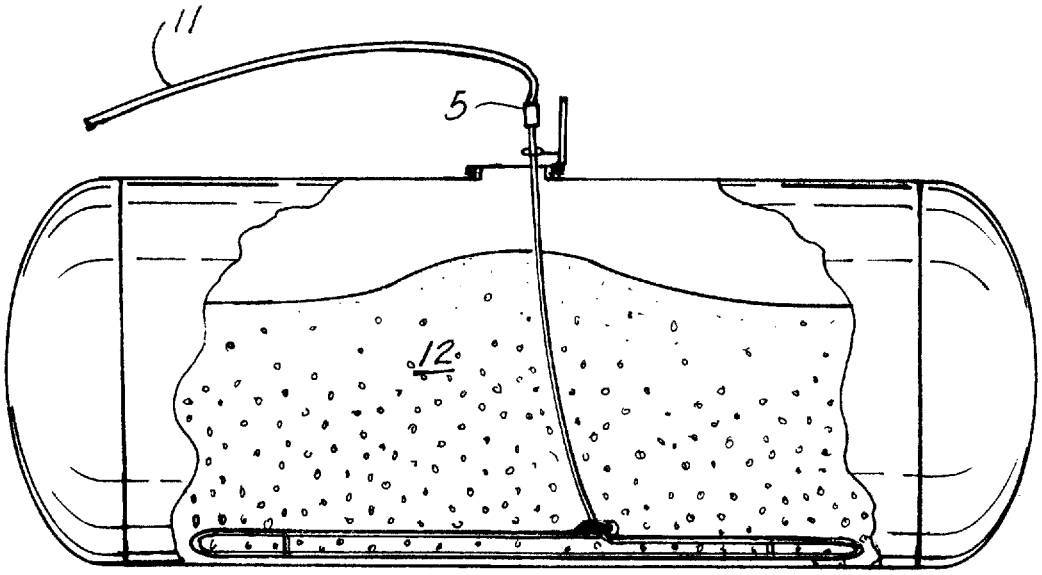
FIG. 4*b* is a side view of the invention of FIG. 1 illustrating the aeration of the contents of the tank of FIG. 4*a* via the sparger system of the present invention.

Once shipped, it may be desirable to put the dry caked shipment in liquid form, necessitating the mixing of the substance with water or other fluid medium. Referring to FIG. 4*a*, a fluid 10 such as, for example, water, is poured into the tank to the desired mixing level, then, referring to FIG. 4*b*, a source of compressed air 11 or the like is attached to the hose connection, and compressed air is pumped therethrough, forcing air through the perforations in the body of the hose, forming aeration bubbles 12, thereby mixing the dry cake with the fluid water to form a fluid slurry or composition, which may be drained from the tank.

In the present container, which could hold, for example, 25000 liters (6,605 gallons), would entail an estimated exemplary load of 30000 lbs in the present example, using, for example 20000 lbs of water, and mixing at 15–20 psi for about three hours, but the above figures may vary widely depending upon the application.

It is noted that the present invention is not limited to shipment of dry cake, and needn't particularly require mixing with water. For example, in a fluid composition which stratifies, such as, for example, pepper mash and vinegar, the present system may be utilized as an inexpensive means to mix the composition after shipment, dispensing with the necessity of mechanical mixers. In such an alternative use, the user would ship the stratified mixture and, upon delivery, open the man cover, affix a source of compressed air or other fluid to the hose coupling, and aereate the stratified liquid until the bubbles or fluid stream emanating from the perforations in the body of the hose stirs up the mixture, mixing same. Further, the pressure of the fluid passing through the hose and hose perforations urges the hose downward, against the sides and/or floor of the tank, aiding in anchoring the hose in place.

The present system is suitable with a plurality of tank shipment containers, such as, for example, IBC tank container, railroad and truck tank cars, media bulk containers, and other portable tanks.

The hose pressure for the mixing hose varies depending upon the application, and may run 15–100 psi or more.

Figure 5A:
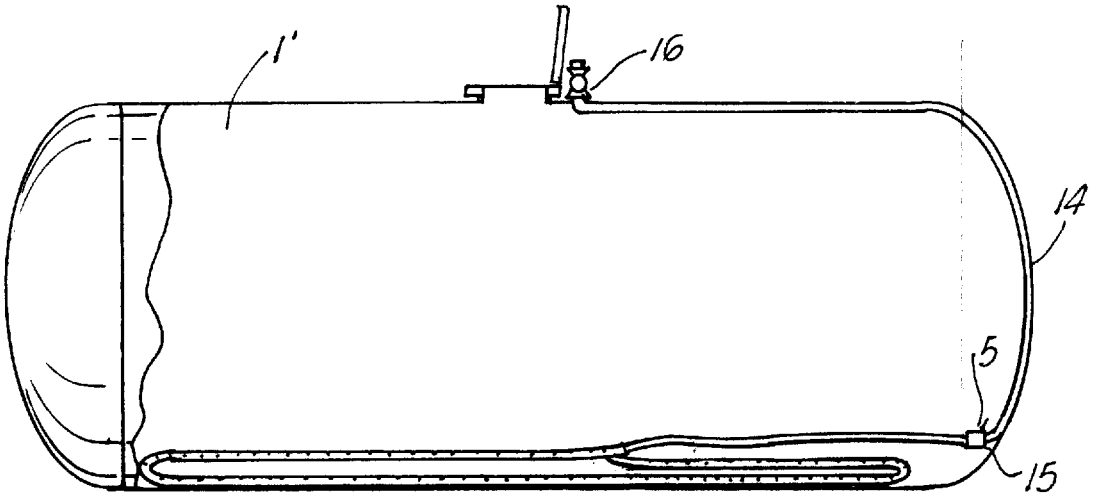
FIG. 5*a* is a side view of an alternative embodiment of the invention of FIG. 1, illustrating the installation of a sparger hose to a tank having an air inlet pipe.
Figure 5B:
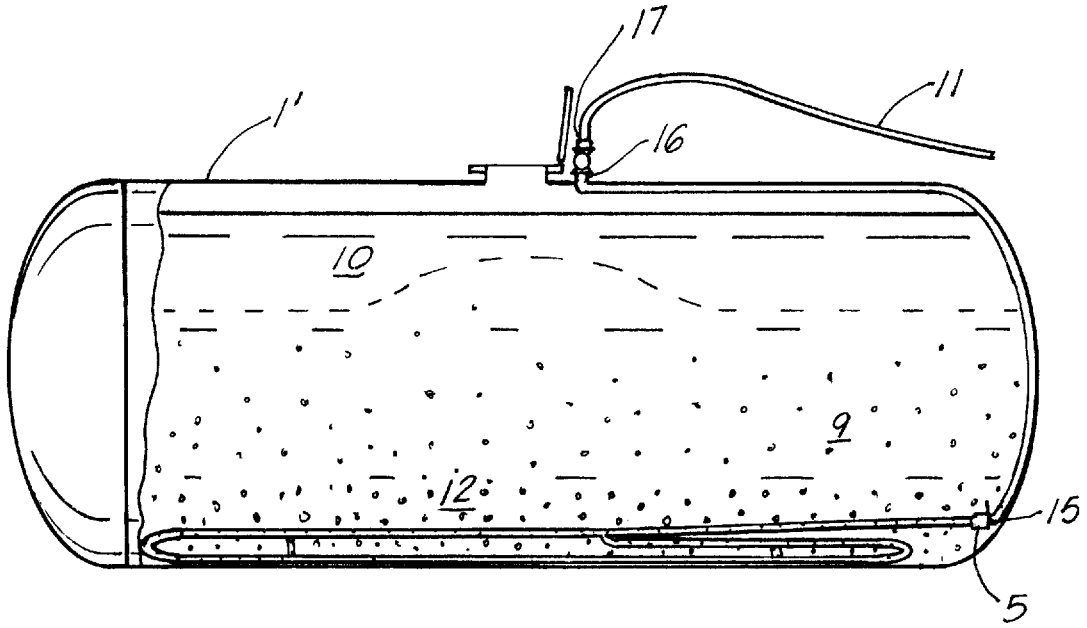
FIG. 5*b* is a side view of the alternative embodiment of the invention of FIG. 5*a*, illustrating the placement of concentrate, then filling of the concentrate with water, aeration, and mixing of the system.
Figure 6:
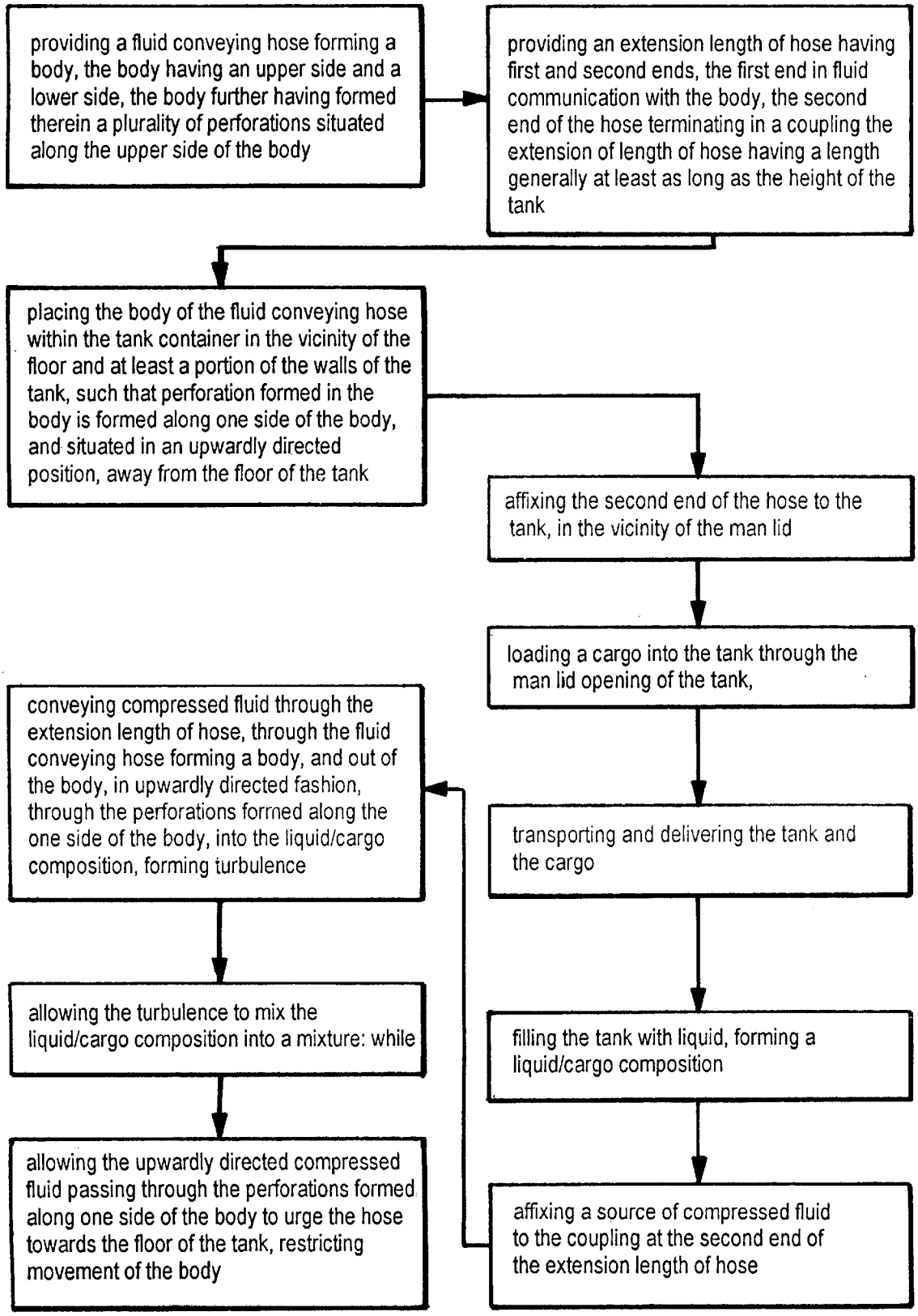
FIG. 6 illustrates a block flow diagram indicating the steps of mixing a cargo in a tank container utilizing the portable sparger mixing system of the present invention.

Installation of the present system in conjunction with a tank 1' having an air inlet pipe 14 is shown in FIGS. 5*a* and 5*b*, wherein the hose is installed on the floor of the tanks as in the earlier embodiment (with the air holes oriented upwards, towards the top of the tank, and with the coupling 5 being linked to the air inlet pipe 14, which runs from the inside lower area of the tank from a coupling 15 to the outer, manhole area, terminating in outer air intake coupling 16, which may be, for example, a 1½ diameter ball or butterfly-type valve.

The operation of this alternative embodiment is similar to that of the earlier embodiment, with the tank 1' being loaded with concentrate 9, for example, in caked form, and the unit being shipped. After arriving at its destination, fluid 10 is applied, a hose 11 is affixed to the outer air intake coupling 16 via hose coupling 17, and compressed air applied, passing through the perforations formed in the hose, forming bubbles 12, providing fluid turbulence to mix the fluid/concentrate composition. As with the principle embodiment, the pressure of the fluid passing through the hose and hose perforations urges the hose downward, against the sides and/or floor of the tank, aiding in anchoring the hose in place.

When the mixture is complete, aeration is halted, and the mixed composition may then be drained as desired.

The hose should be removed only after the tank has been emptied, and where applicable, cleaned. Dry air should be blown through the hose to ensure that residual product has not clogged any of the holes or perforations formed in the body of the hose.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A portable sparger system for use with a transport tank container having a floor, walls, a man lid, and a height, comprising:

a fluid conveying hose forming a body, said body having an upper side and a lower side, said body further having formed therein a plurality of perforations situated along said upper side of side body, said body configured to generally rest, and situated in, the vicinity of the floor of the tank said body forming a loop, said loop further comprising first and second cross member hoses running from one portion of said loop to another portion of said loop;

an extension length of hose having first and second ends, said first end in fluid communication with said body, said second end of said hose terminating in a coupling, said extension of length of hose having a length generally at least as long as the height of the tank;

means for affixing said second end of said hose to the tank, in the vicinity of the manlid.

2. The portable sparger system for use with a transport tank container having a floor, walls, a man lid, an air outlet coupling situated on the interior off the tank, and an air inlet coupling situated exterior of the tank, said portable sparger system comprising:

a fluid conveying hose forming a body, said body having an upper side and a lower side, said body further having formed therein a plurality of perforations situated along said upper side of side body, said body configured to generally rest, and situated in, the vicinity of the floor of the tank said body forming a loop, said loop further comprising first and second cross member hoses running from one portion of said loop to another portion of said loop;

an extension length of hose having first and second ends, said first end in fluid communication with said body, said second end of said hose terminating in a coupling, said coupling configured to communicate with the interior air outlet coupling of the tank.

3. The method of mixing a cargo in a transport tank container having a floor, walls, a man lid configured to cover a man lid opening, and a height, comprising:

a. providing a fluid conveying hose forming a body, said body having an upper side and a lower side, said body further having formed therein a plurality of perforations situated along said upper side of said body;

b. providing an extension length of hose having first and second ends, said first end in fluid communication with said body, said second end of said hose terminating in a coupling, said extension of length of hose having a length generally at least as long as the height of the tank;

c. placing said body of said fluid conveying hose within said tank container in the vicinity of the floor and at least a portion of the walls of the tank, such that perforation formed in said body is formed along one side of said body, and situated in an upwardly directed position, away from the floor of the tank;

d. affixing said second end of said hose to the tank, in the vicinity of the manlid;

e. loading a cargo into the tank through the man lid opening of the tank;

f. transporting and delivering said tank and cargo;

g. filling said tank with liquid, forming a liquid/cargo composition;

h. affixing a source of compressed fluid to said coupling at said second end of said extension length of hose;

i. conveying compressed fluid through said extension length of hose, through said fluid conveying hose forming a body, and out of said body, in upwardly directed fashion, through the perforations formed along said one side of said body, into said liquid/cargo composition, forming turbulence;

j. allowing said turbulence to mix said liquid/cargo composition into a mixture; while k. allowing said upwardly directed, compressed fluid passing through the perforations formed along one side of said body to urge the hose towards the floor of the tank, restricting movement of said body.

4. The method of mixing a cargo in a transport tank container having a floor, walls, a man lid, an air outlet coupling situated on the interior of the tank, and an air inlet coupling situated exterior of the tank, a man lid opening, and a height, comprising the steps of:

a. providing a fluid conveying hose forming a body, said body having a upper side and a lower side, said body further having formed therein a plurality of perforations situated along said upper side of said body;

b. providing an extension length of hose having first and second ends, said first end in fluid communication with said body, said second end of said hose terminating in a coupling;

c. placing said body of said fluid conveying hose within said tank container in the vicinity of the floor and at least a portion of the walls of the tank, such that perforation formed in said body is formed along one side of said body, and situated in an upwardly directed position, away from the floor of the tank;

d. placing said coupling at said second end of said extension hose in communication with said air outlet coupling situated in the interior of the tank;

e. loading a cargo into the tank through the man lid opening of the tank;

f. transporting and delivering said tank and cargo;

g. filling said tank with liquid, forming a liquid/cargo composition;

h. affixing a source of compressed fluid to the air intake coupling situated on the exterior of the tank;

i. conveying compressed fluid through said extension length of hose, through said fluid conveying hose forming a body, and out of said body, in upwardly directed fashion, through the perforations formed along said one side of said body, into said liquid/cargo composition, forming turbulence;

j. allowing said turbulence to mix said liquid/cargo composition into a mixture; while k. allowing said upwardly directed, compressed fluid passing through the performations formed along one side of said body to urge the hose towards the floor of the tank, restricting movement of said body.

* * * * *